US010629102B2

(12) United States Patent
Bauer et al.

(10) Patent No.: US 10,629,102 B2
(45) Date of Patent: Apr. 21, 2020

(54) CORRIDOR INDICATOR LAMP COMPRISING EXTENSION UNIT

(71) Applicant: CCS Care Communication Solutions GmbH, Vienna (AT)

(72) Inventors: Harald Bauer, Brunnthal (DE); Werner Schuhmann, Munich (DE)

(73) Assignee: CCS Care Communication Solutions GmbH, Vienna (AT)

( * ) Notice: Subject to any disclaimer, the term of this patent is extended or adjusted under 35 U.S.C. 154(b) by 0 days.

(21) Appl. No.: 15/175,090

(22) Filed: Jun. 7, 2016

(65) Prior Publication Data

US 2017/0018212 A1 Jan. 19, 2017

(30) Foreign Application Priority Data

Jul. 14, 2015 (EP) ..... 15176618

(51) Int. Cl.
*F21V 3/02* (2006.01)
*G09F 13/04* (2006.01)

(52) U.S. Cl.
CPC ..... *G09F 13/0413* (2013.01); *F21V 3/02* (2013.01); *G09F 13/04* (2013.01);
(Continued)

(58) Field of Classification Search
CPC ..... F21W 2111/00; G08B 5/36; G09F 13/04; G09F 13/0413; G09F 2013/0481; F21S 8/00
See application file for complete search history.

(56) References Cited

U.S. PATENT DOCUMENTS 3,220,001 A * 11/1965 Hallerberg ..... H01H 9/161 340/815.5
3,600,569 A * 8/1971 Matteson ..... F21S 8/02 362/309

(Continued)

FOREIGN PATENT DOCUMENTS

CN 202871234 U 4/2013
DE 202005018047 U1 2/2006

(Continued)

OTHER PUBLICATIONS

Extended European Search Report, dated Dec. 16, 2015, from European Application No. 15176618.5, filed on Jul. 14, 2015. Seven pages.

(Continued)

*Primary Examiner* — Christopher Stanford
(74) *Attorney, Agent, or Firm* — Quarles & Brady LLP

(57) ABSTRACT

The invention relates to a corridor indicator lamp (1). The corridor indicator lamp (1) comprises a base assembly (12) which includes a plurality of compartments (4) and a plurality of separator walls (46). The compartments (4) are open towards a front side (14) of the corridor indicator lamp (1). The separator walls (46) separate at least some of the plurality of compartments (4). In order to improve visibility of the indicator lamp (1), an extension unit (54) is provided according to the invention. The extension unit (54) is configured to be mounted to the base assembly (12) and has a plurality of extension walls (58). An at least partly transparent cover (16) may be further provided, which is adapted to receive the extension unit (54).

20 Claims, 7 Drawing Sheets

(52) U.S. Cl.
CPC ..... *G09F 2013/0436* (2013.01); *G09F 2013/0459* (2013.01); *G09F 2013/0481* (2013.01)

(56) References Cited

U.S. PATENT DOCUMENTS

| | | | | |
|---|---|---|---|---|
| 6,693,514 | B2 | 2/2004 | Perea, Jr. et al. | |
| 7,988,322 | B2 * | 8/2011 | Zheng | F21V 5/00 362/218 |
| 2004/0222897 | A1 * | 11/2004 | Schuhmann | G08B 5/222 340/815.45 |
| 2009/0262532 | A1 * | 10/2009 | Wilcox | F21V 5/04 362/248 |
| 2014/0362559 | A1 * | 12/2014 | Chien | H02G 3/14 362/95 |

FOREIGN PATENT DOCUMENTS

| | | | |
|---|---|---|---|
| DE | 102007017329 | B4 | 11/2010 |
| DE | 40505832-0009 | | 10/2013 |
| EP | 0833547 | B1 | 6/2001 |
| JP | H0684405 | A | 3/1994 |

OTHER PUBLICATIONS

Office for Harmonization in the Internal Market Certificate of Registration for Registered Community Design No. 00911987-0115, registered Apr. 4, 2008. Issued to GIRA Giersiepen GmbH & Co. KG. Four pages.

* cited by examiner

CORRIDOR INDICATOR LAMP COMPRISING EXTENSION UNIT

RELATED APPLICATIONS

This application claims priority to European Patent Application No. 15 176 618.5 filed on Jul. 14, 2015 which is incorporated herein by reference in its entirety.

BACKGROUND AND SUMMARY OF THE INVENTION

The invention relates to a corridor indicator lamp.

Corridor indicator lamps may be used indoor or outdoor to either provide information to passers-by or personnel. The information provided may concern directions or the state of a room or corridor, such as its occupancy, availability or accessibility, or requests of occupants of a room, such as patients and their condition.

To provide information, for example information pertaining to several different rooms, or to display different states of one or more rooms, the corridor indicator lamp may be provided with compartments, wherein each compartment may be shielded with respect to a neighboring compartment by a preferably opaque separator wall. At least one socket or at least one light source, which may be connected to the socket, is associated with each compartment. Providing energy to the socket and/or the light source illuminates the compartment and thus the information associated with that compartment.

The information may be applied as a masking, e.g. a lettering directly on an at least partly transparent cover of the corridor indicator lamp or provided on a foil inside or outside the cover. Alternatively or additionally, the mere switching on or off of the light source in a compartment may present the information to be conveyed by the respective compartment. For example, switching on a light source in a compartment may indicate that a room associated with this compartment is occupied. Further, if light sources or different colors are associated with each compartment, or a single light source capable to display various colors are used, the color of the illumination of the compartment may also be used to convey information to an observer.

There is a problem, however, in that the corridor indicator lamp may not have enough visibility e.g. at curved corridors, in areas of exposed brickworks or doors, or at wall projections, and in such a situation, can be overlooked as it is blocked from view.

This problem is solved according to the invention by providing a corridor indicator lamp comprising a base assembly, the base assembly including a plurality of compartments, which are open towards a front side of the corridor indicator lamp, and preferably also laterally, further including a plurality of preferably opaque separator walls, at least some of the plurality of compartments being separated from each other by at least some of the plurality of separator walls, wherein the corridor indicator lamp further comprises an extension unit, which is configured to be mounted to the base assembly and which has a plurality of extension walls, which, in a position where the extension unit is mounted to the base assembly, extend at least one of the plurality of the compartments in a direction pointing away from the base assembly, the corridor indicator lamp further comprising an at least partly transparent cover, the cover being configured to receive the extension unit.

This solution has the advantage of providing a base assembly, which already comprises compartments, and may be used without the extension unit e.g. on level walls, where it cannot be concealed by wall projections or architraves. In situations, where visibility is impaired by e.g. curved corridors, door frames, other equipment mounted to the wall or wall projections, the extension unit may be used. By enlarging the compartments of the base unit in a direction facing away from the base unit, visibility is extended to a greater distance from the wall.

The same advantage is obtained by a set for assembling a corridor indicator lamp, where the set comprises a base assembly and the base assembly includes a plurality of compartments, which are open towards a front side of the corridor indicator lamp, and a plurality of separator walls, where at least some of the plurality of compartments are separated from each other by at least some of the plurality of separator walls. The set may further comprise an extension unit having a plurality of extension walls, and a first and a second at least partly transparent cover, wherein the first at least partly transparent cover is configured to receive the extension unit and the first and the second at least partly transparent cover are configured to be mounted, preferably alternatively, to the base assembly, and wherein the first at least partly transparent cover protrudes at a greater height from the base assembly than the second at least partly transparent cover.

Such a set results in a corridor indicator lamp, which can be adapted in its height to the requirements at the specific location, where it is to be mounted. If the location provides good visibility for the corridor indicator lamp, the flat cover may be used. At a location, which is partly shielded from view, the second cover may be used together with the extension unit.

Finally, it is also provided according to the invention, that existing lamps may be retrofitted with an extension kit which is configured to be mounted to a corridor indicator lamp having at least two compartments associated with different light sockets, the retrofit kit comprising an extension unit, which includes a plurality of extension walls, extending substantially parallel to each other and being adapted to enlarge the compartments of the corridor indicator lamp.

By means of such a retrofit kit, the visibility of existing corridor indicator lamps may be improved.

The solution according to the invention may he amended by independently adding further features, as is explained in the following.

For example, the base assembly may comprise a plurality of sockets, which are each adapted to receive a light source such as an LED, a light bulb, a neon lamp, or a florescent tube. Each of the compartments may comprise at least one of the plurality of sockets. In order to achieve a uniform illumination of the compartment, a plurality of sockets in each compartment may be preferred, especially if the compartment is significantly larger than a single light source.

If at least some of the extension walls are provided with at least one predetermined breaking line, the versatility of the extension unit may be increased further. The extension wall may be broken off at the least one predetermined breaking line so that the two compartments that were previously separated by the extension wall are now combined. Preferably, the at least one predetermined breaking line is located at, adjacent to, or in a base of the extension wall, the base being situated opposite a free end of the extension wall, towards the base assembly. This configuration allows to break off as much of the extension wall as possible and thus to achieve a more uniform distribution of light within a combined compartment. Further, several predetermined breaking lines may be provided at different distances from the base, so that various levels of shielding can be maintained between the compartments depending on where the extension wall has been broken off.

At least one, preferably some, or all of the plurality of separator walls may be parallel to at least one, some, or all of the plurality of extension walls. Thus, the geometry of the compartments as defined by the base assembly may be continued linearly by the extension unit.

In order to both secure the extension unit on the base assembly and to provide a light-impermeable connection between the extension unit and the base assembly, the extension unit may comprise at least one pocket which is configured to receive at least parts of one of the plurality of separator walls. Thus, the separator wall may extend into the pocket, once the extension unit has been mounted to the base assembly.

The pocket may comprise two parallel walls spaced apart from each other. The spacing between the two parallel walls may correspond to the thickness of the associated separator wall. In this, the associated separator wall is the one of the plurality of separator walls which is received in the pocket when the extension unit is mounted to the base assembly.

At least one, preferably some, most preferably all of the extension walls are aligned with at least one, some, or all of the plurality of pockets and may, in particular, be co-planar to the pockets. This configuration ensures that the compartments are continued parallel to each other.

According to another aspect of the invention, the pocket may cover only a part of the associated separator wall. The part which is covered by the pocket may, in particular, be situated in a center of the corridor indicator lamp.

At least one, some, or all of the plurality of extension walls may extend from one of the plurality of pockets. Thus, the pockets may serve as the base of the extension walls for stiffening and light-shielding purposes.

The at least one predetermined breaking line may be located between at least one, some, or all of the plurality of extension walls and an associated pocket. Herein, the associated pocket is the one of the plurality of pockets from which the extension wall extends and/or which forms the base of the extension wall.

At least one, some, or all of the separator walls and/or at least one, some, or all of the extension walls may have a convexly curved free end and thus may be shaped as an arch extending in a width direction of the corridor indicator lamp. The covers may be correspondingly curved. Using such a curvature ensures good recognizability and readability of any markings of a compartment. The free end of the at least one, some, or all of the plurality of extension walls may have a larger curvature, i.e. may be arched more strongly than the free end of the separator wall.

At least one, some or all of the plurality of extension walls may be provided with at least one cutout which is shaped complementary to an associated one of the plurality of separator walls. In particular, the cutout may be arched, if the separator wall is arched also. The associated separator wall is that separator wall which is extended by the extension wall once the extension unit has been mounted to the base assembly. Using a complementarily shaped cutout, in which the extension wall most preferably snugly fits, reduces leakage of light from one compartment to the other.

To allow for maintenance or repair work in particular of the at least one light source within a compartment, the extension unit is preferably configured to be releasably mounted to the base assembly. It is further preferred that the fixation of the extension unit to the base assembly can be effected without tools. For this, the extension unit may comprise locking elements, such as latches or clips, and, in general, may be configured to be clicked or locked to the base assembly.

The extension unit may comprise a cage-like holding structure. The extension walls and, if present, the pockets, may extend perpendicular from the holding structure. If pockets are used to receive the separator walls, their walls may serve as an immediate support from the extension walls. The holding structure may be provided with at least one opening per compartment. The opening should be aligned with a socket of the base assembly once the extension unit is mounted to the base assembly, to allow a light source to extend through the opening. In one particular embodiment, the holding structure may comprise a series of U-shaped brackets that are connected to each other at their adjacent legs. Between the adjacent legs of neighboring brackets, a pocket as described above may be formed. Each bracket may define one compartment.

Furthermore, an at least partly transparent cover may be provided, which is adapted to receive the extension unit. The extension unit and the cover may be configured to be fixed, preferably releasably, onto one another, for example by clips and/or latches, in order to form a preassembled cover unit which is then mounted to the base assembly. Thereby, the cover receiving the extension unit may use fixation elements that are otherwise used for a smaller cover of lesser height, which is used instead of the cover adapted to the extension unit, if visibility of the corridor indicator lamp is not impaired at its location at the wall.

One, some, or all of the plurality of the extension walls may rest at least partly on the cover. This not only minimizes the bleeding of light from one compartment to the other, but allows also the fixation of a foil between the extension wall and the cover. The foil may be provided with markings which are visible from outside the cover and be illuminated from the at least one light source in the compartment.

In cases where the increased height of the corridor indicator lamp with the indicator unit and the associated cover is still not sufficient, an elevation socket may be provided which is configured to be attached to the base assembly preferably on a side opposite the plurality of separator walls and/or the extension unit respectively.

In addition to the elevation socket and the base assembly, a mounting frame may be provided, which is configured to be mounted to a wall e.g. by providing holes for wall-mounting screws. The elevation socket and the mounting frame may be configured to use the same fixation elements provided on the base assembly. The elevation socket may provide the same fixation elements on one of its sides as the base assembly, thus allowing the mounting frame to be mounted to the elevation socket in the same manner as to the base assembly.

A set comprising the two light covers, the extension unit, the base assembly, the elevation socket and the mounting frame results in a corridor indicator lamp which can be configured to achieve excellent visibility independent of the situation at the location where the indicator lamp is to be mounted on a wall.

In the following, the invention is exemplarily described by means of an embodiment which is also shown schematically in the accompanying figures. In the figures, the same reference numerals are used for elements, which are identical or similar in at least one of function and design. It will be understood that the particular method and device embodying the invention are shown by way of illustration and not as a limitation of the invention. The principles and features of this invention may be employed in various and numerous embodiments without departing from the scope of the invention.

BRIEF DESCRIPTION OF THE DRAWINGS

In the accompanying drawings, reference characters refer to the same parts throughout the different views. The drawings are not necessarily to scale; emphasis has instead been placed upon illustrating the principles of the invention. Of the drawings.

DETAILED DESCRIPTION OF THE PREFERRED EMBODIMENTS

Figure 1:
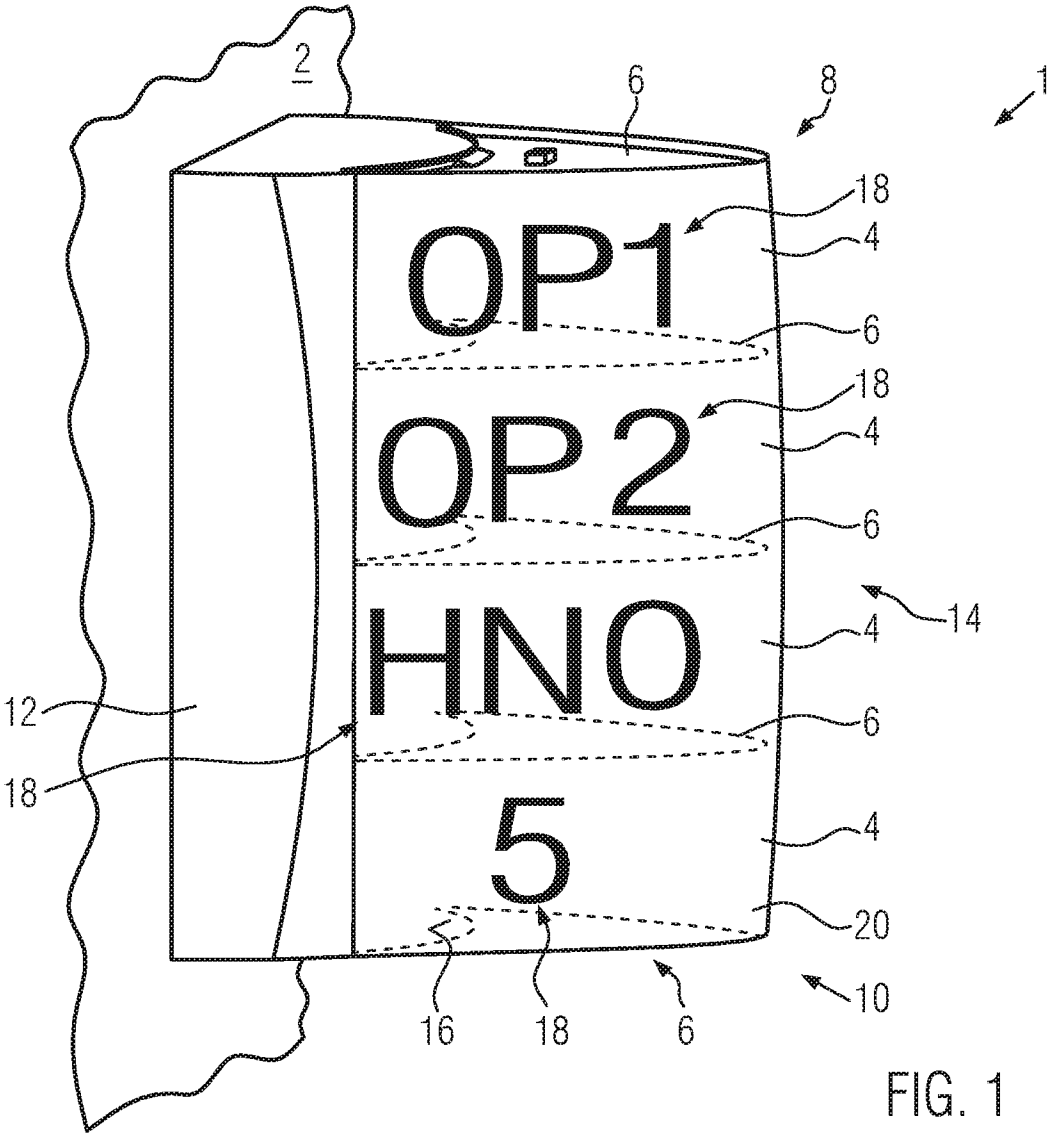
FIG. 1 shows a schematic perspective view of a corridor indicator lamp according to the invention.

FIG. 1 exemplarily shows a possible configuration of a corridor indicator lamp 1 according to the invention. The corridor indicator lamp 1 may be used indoor or outdoor on a preferably planar support structure 2, such as a wall.

The corridor indicator lamp 1 comprises a plurality of, in particular at least two, compartments 4, which are separated from each other by walls 6. The compartment 4 at the top 8 and the compartment 4 at the bottom 10 of the corridor indicator lamp 1 may also be terminated by a wall 6.

The compartments 4 extend from a base assembly 12 in a direction facing away from the support surface 2. They may be open towards a front side 14 and also laterally or, equivalently, horizontally. Where they are open, the compartments 4 may be covered by an at least partly translucent cover 16, which is mounted to the base assembly 12.

As is seen in FIG. 1, any compartment may be provided with a marking 18, which, in particular, may vary from compartment 4 to compartment 4. Some compartments 4 may not be marked at all. The marking 18 may be printed, glued or applied otherwise directly on the cover 16 or on a foil 20, which is applied either on the cover 16 or between the cover 16 and the walls 6.

At its back towards the base assembly 12, each compartment 4 may be provided with at least one light source (not shown) or at least one means to connect and provide energy to such a light source, for example a socket (not shown). The compartments 4 are shielded from each other by the walls 6 so that illumination of one particular compartment 4 only illuminates this compartment and not any of the neighboring compartments. Thus, switching on the at least one light source in one compartment illuminates only this compartment 4 and the corresponding area of the cover 16 and the marking 18 which is arranged on this area of the cover 16.

As can be seen, the corridor indicator lamp 1 is in operation preferably oriented such that the at least two compartments 4 are stacked one above the other vertically. It is only for explanatory purposes that four compartments 4 are shown. Depending on the particular application, more or less compartments may be needed and provided. The compartments 4 may further be arranged side-by-side horizontally, or the compartments 4 may further be sub-divided so that an array of compartments 4 comprising a plurality of rows and columns results.

The corridor indicator lamp 1 may, in operation, be located close to one or more doors leading to one or more rooms. The illumination of a compartment 4 or a color of the illumination of a respective compartment 4 may indicate a status of the room associated with the compartment and the marking 18. Alternatively or additionally, the marking 18 may directly indicate a status, such as "occupied" or "do not enter".

Figure 2:
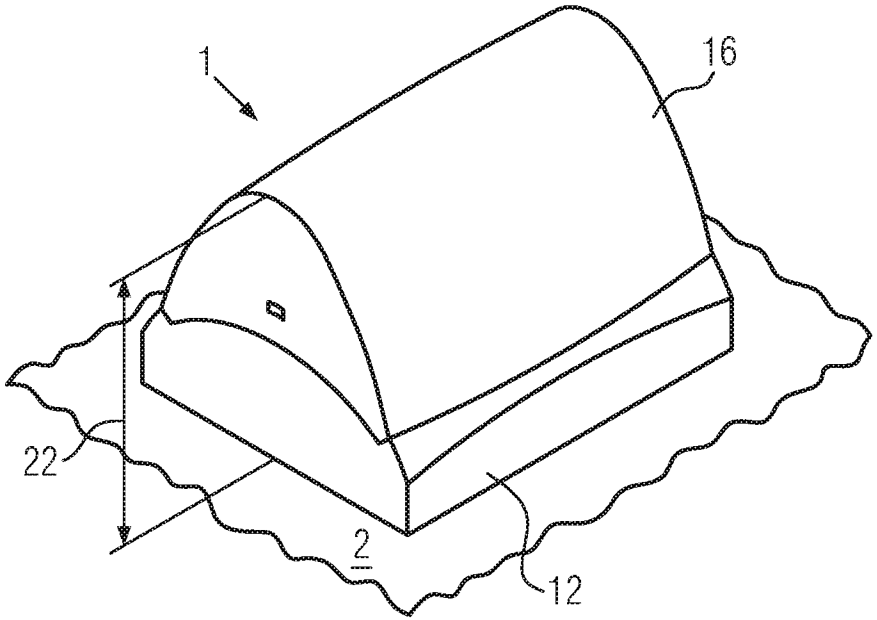
FIG. 2 shows another perspective schematic view of the corridor indicator lamp according to the invention.
Figure 3:
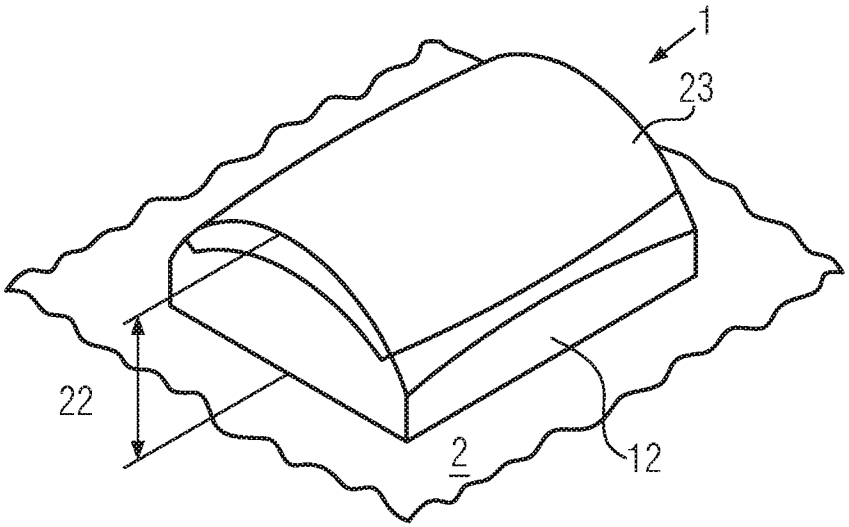
FIG. 3 shows a schematic perspective view of the corridor indicator lamp according to the invention in another configuration.

FIGS. 2 and 3 show two different configurations of the corridor indicator lamp 1. The different configurations result from a different combination taken from a set of parts, as is explained in greater detail below.

In the configuration of FIG. 2, the corridor indicator lamp 1, especially its cover 16, extends over a larger height 22 from the support 2 than the corridor indicator lamp 1 or its cover 16 in the configuration of FIG. 3. In both configurations, however, the same base assembly 12 is used.

The greater height 22 of the configuration FIG. 2 is particularly advantageous in locations, where the visibility of the corridor indicator lamp 1 for passers-by is impaired. This may be the case, if part of the flat cover 23 is blocked from view by e.g. a wall protection, a door frame, an architrave, or other parts of a building or the curvature of the wall. Increasing the height 22 in such a situation increases the visibility of the corridor indicator lamp 1. On the other hand, in situations, where an increased height 22 is not needed because the configuration as shown in FIG. 3 has already sufficient visibility, it may be advantageous to use the flatter configuration of the corridor indicator lamp of FIG. 3, which does not extend too far from the support structure 2 and thus does not cover other installations on the support structure 2.

Next, an exemplary structure of the configuration of FIG. 3 is explained with reference to FIG. 4.

As shown, the base assembly 12 need not be directly mounted on the support structure 2. Rather, amounting frame 24 may be provided. The mounting frame 24 may have a central opening 26, through which, in operation, cables for controlling and/or providing energy to the corridor indicator lamp 1 may be provided. Further openings 28 may be configured to receive fixation elements, such as screws, to mount the mounting frame 24 to the support structure 2 (FIG. 1).

In another variant of the corridor indicator lamp 1, the base assembly 12 may be provided with an integral backplane, which may be substantially of the same configuration as the mounting frame 24, but which may be monolithically integrated into the base assembly 12. To facilitate mounting and connecting the corridor indicator lamp 1 to the energy source and to a control device, it may be advisable to gain access to the backplane through a front opening of the base assembly 12.

Figure 4:
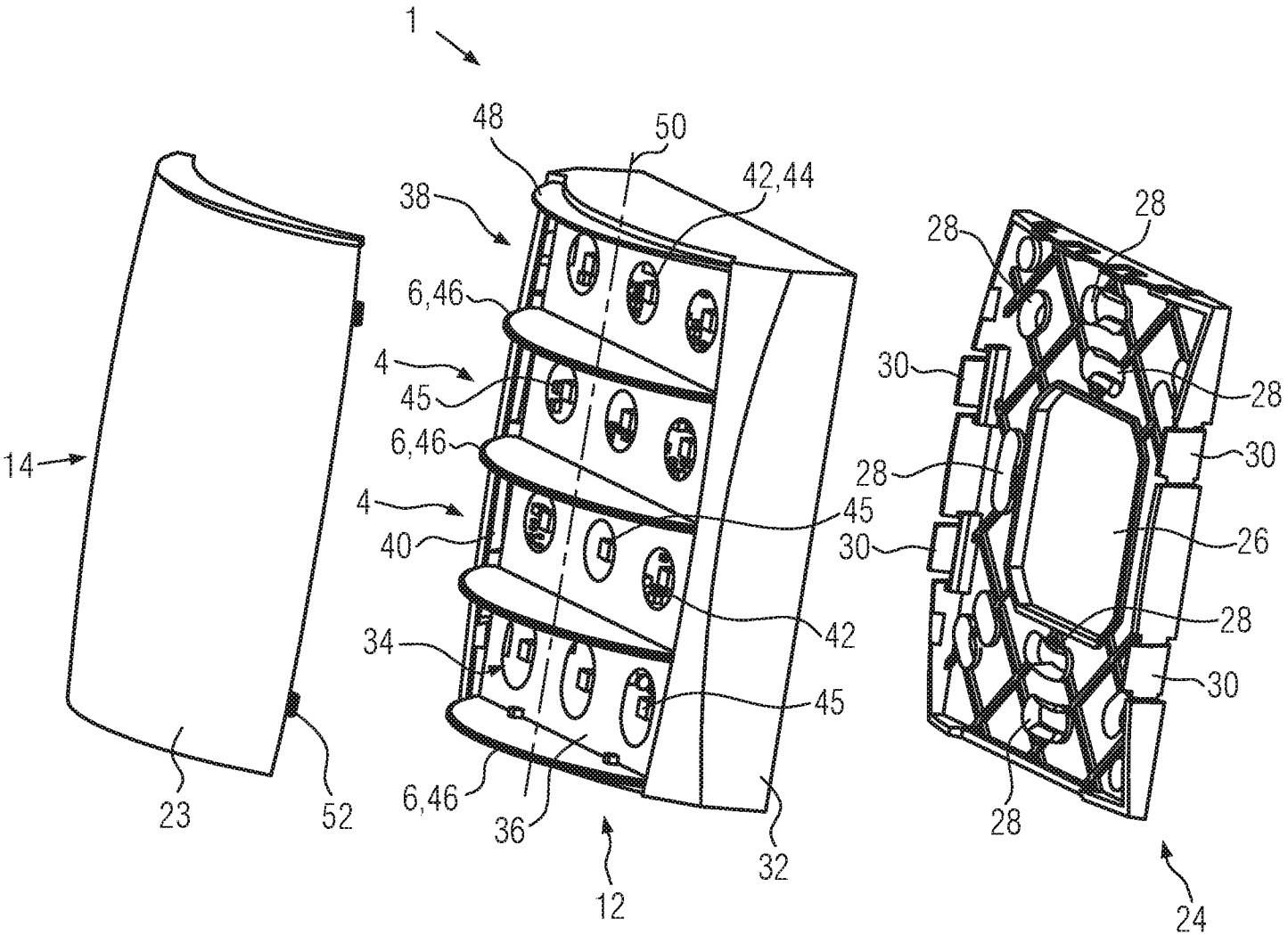
FIG. 4 shows a schematic exploded view of the corridor indicator lamp according to the invention.

The base assembly 12 in the configuration shown in FIG. 4 may be configured to be preferably releasably attached to the mounting frame 24. The mounting frame 24 may be received in the base assembly 12, so that it is not visible from the outside. A fixation of the mounting frame 24 and the base assembly 12 to one another may be effected by clips or other latching means 30 which do not require tools for handling and operation. The latching means are preferably also received within the base assembly 12 and may not be visible from the outside once the base assembly 12 and the mounting frame 24 have been assembled.

The base assembly 12 may comprise a frame element 32 and an electric subassembly 34 which may be at least partly, preferably completely, covered by an ESD protection foil 36, which shields the electric subassembly 34 against electrostatic discharges and serves as a frontal plane element closing the front 44 of the base assembly 12. It is preferred that the foil is configured to be at least partly light-reflecting, e.g. by being white or silver, in particular in its part which is facing to the front (14) of the corridor indicator lamp 1, i.e. facing away from the support structure 2 (FIG. 1).

The ESD protection foil 36 may cover a front opening 38 of the base assembly 12 preferably completely. The ESD protection foil 36 preferably covers and thus protects most of the electric subassembly 34. The ESD protection foil 36 may be locked in place by latching elements 40 e.g. in the form of protrusions, which may be monolithically integrated into the base assembly 12, in particular the frame element 32. In particular, the ESD protection foil 36 may be jammed between the lower side of the compartment walls 6 and latches on the side walls of the frame 32.

The base assembly 12 provides at least one socket 42 per compartment 4. As is shown in FIG. 4, three or more sockets 42 may be used per compartment. Such an increased number of sockets 42 may be useful, if a compartment 4 should be illuminated very evenly. Providing more than one socket increases the amount of available light for each compartment and provides light if one light source fails.

The sockets 42 may be provided by the electric subassembly 34 and may include a standardized connector for connecting LEDs, light bulbs, fluorescent lights, and/or neon tubes, The ESD protection foil 36 may be provided with transparent areas 44 which correspond in their location to the location of the sockets (42) in the base assembly 12. The transparent areas 44 may result from only partly providing the ESD protection foil with lacquer. In FIG. 4, an LED 45 is mounted to the socket 4 behind each transparent area 44.

The base assembly 12 further comprises separation walls 46, which may form at least part of the walls 6 shown in FIG. 1. The separation walls 46 may be substantially parallel to each other. The separation walls 46 may further have a free end 48, which may he curved convexly to form an arch perpendicular to a center line 50 of the base assembly 12. The height of the separation walls 46 may be largest along the center line 50. The base assembly 12 may have a polygonal, in particular rectangular base area. Laterally, the height of the separation walls 46 may taper, in particular to a zero height.

The separation walls 46 may be monolithically combined with a frontal plane element or be separate elements which are fixed to the frontal plane element or the frame element 32. The separation walls 46 may also be a monolithical part of the frame 32, In this case, the ESD protection foil is mounted from the back of the base assembly.

The cover 23 is adapted to be mounted, preferably by clips or other latching members 52 to the base assembly 12. It has a curvature, which corresponds to the curvature of the free end 48 of the separation walls 46. Preferably, the cover 23 rests snugly on the free ends 48, so that no light bleeding occurs at the free ends 48 between the cover 16 and the separation walls 48.

The cover 23 should be releasably attached to the base assembly 12 to allow access to the interchangeability between the different covers 16, 23 and to allow access to a service button (not shown) which is situated behind the ESD protection foil and can be pushed through the foil.

The cover 23, the base assembly 12, and if present, the mounting frame 24 are all made from a resin material e.g. by injection-molding. Whereas the base assembly 12, and if present, the mounting frame 24 are made preferably from opaque material, the cover 16 is at least partly or completely transparent. It may have a milky transparency in order to distribute the light generated by the light source of a compartment more evenly.

Figure 5:
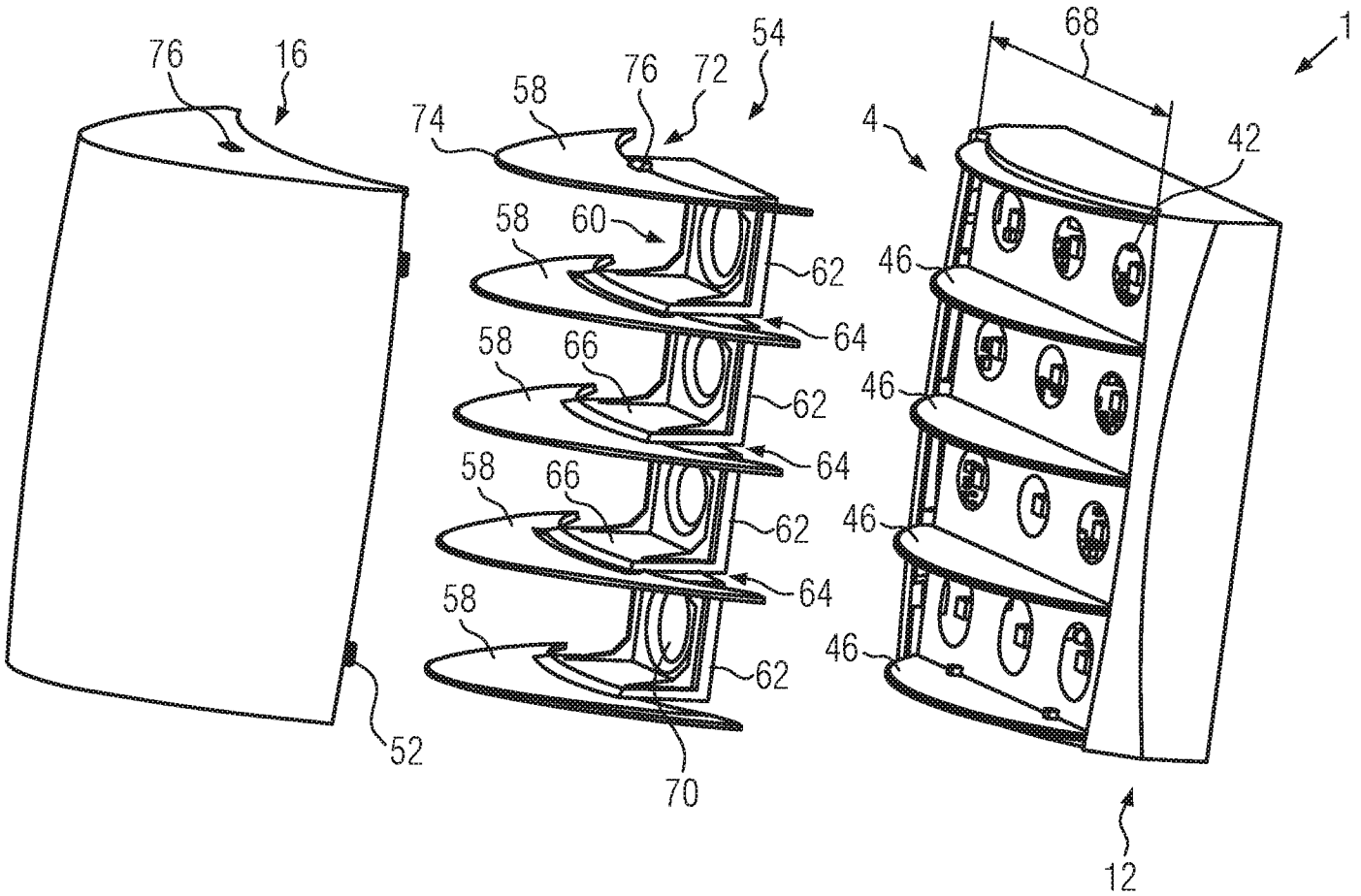
FIG. 5 shows a schematic exploded view of the corridor indicator lamp according to the invention in another configuration.

In FIG. 5, the configuration of FIG. 2 of the corridor indicator lamp 1 is shown in more detail. The base assembly 12 in FIG. 5 corresponds to the base assembly 12 as discussed above in relation to FIG. 4.

To increase the height 22 (FIG. 2; FIG. 3) of the corridor indicator lamp 1, an extension unit 54 and the different cover 16 may be used instead of the cover 23 shown in FIG. 4. Except for the different height, the covers 16 and 23 correspond to each other and are thus interchangeable.

The extension unit 54 comprises a plurality of extension walls 58, which may be parallel to each other.

Preferably, the location, orientation, number and/or alignment of the extension walls 58 correspond to the location, orientation, number and/or alignment of the separation walls 46.

The extension walls 58 may be carried by a holding structure 60. The holding structure may be comprised by a succession of, for example, U-shaped brackets 62. The legs of adjacent brackets 62 may be joined by an extension wall 58.

The extension unit 54 comprises pockets 64 for receiving at least part of the separation walls 46, In the variant shown in FIG. 5, a pocket 64 is formed between the adjacent legs 66 of the brackets 62.

The pockets 64 serve to receive at least parts of the separation walls 46 n the extension unit 54 is mounted to the base assembly 12.

The brackets 62 may not cover the whole width 68 of the base assembly 12 or the front opening 38. Instead, the holding structure 60 may be restricted to an area around the center line 50 (FIG. 4) and leave parts of the transparent areas 38 of the ESD protection foil 36 uncovered.

In the variant shown in FIG. 5, more than one socket 42 is provided for each compartment or at least some compartments 4, One of the sockets 42 may be situated at the center line 50, whereas other sockets 42 may be located off the center line 50 but in a perpendicular direction with respect to the center line 50. The holding structure 60 may be provided with socket openings 70 that are aligned with the center line 50 when the extension unit 54 is attached to the base assembly 12. In particular, the holding structure 60 may just extend around the center sockets 42.

The extension walls 58 may be provided with a cutout 72 which is preferably shaped complementary to a separation wall 46. The cutout 72 is located at the side of the extension wall 58 facing the base assembly 12 in the assembled state.

In the state where the extension unit 54 is attached to the base assembly r 12, the separation wall 46 preferably fits snugly into the cutout 72.

The extension walls 58 may continue as seamlessly as possible the separation walls 46 and by the extension unit 54, the compartments 4 are enlarged in a direction facing away from the base assembly 12 and a support structure 2 (FIG. 1).

The free end 74 of the extension walls 58 may be curved convexly to form an arch but with a higher curvature than the curvature of the free end 48 of the separation walls 46. Thus, greater height is attained for the corridor indicator lamp 1.

The cover 16 is adapted to receive the extension unit 54. In the variant shown in FIG. 5, the extension unit 54 and the cover unit 16 are adapted to be fixed together and form a preassembled part, which may be fixed as a unit to the base assembly 12 instead of the cover 16 of the flat configuration of the corridor indicator lamp 1.

For forming the preassembled unit, the cover 16 and the extension unit 54 may be provided with complementary locking or latching elements 76 which may be brought into a preferably releasable engagement to each other. The cover 16 uses the same latching members 52 as the cover 16.

Figure 6:
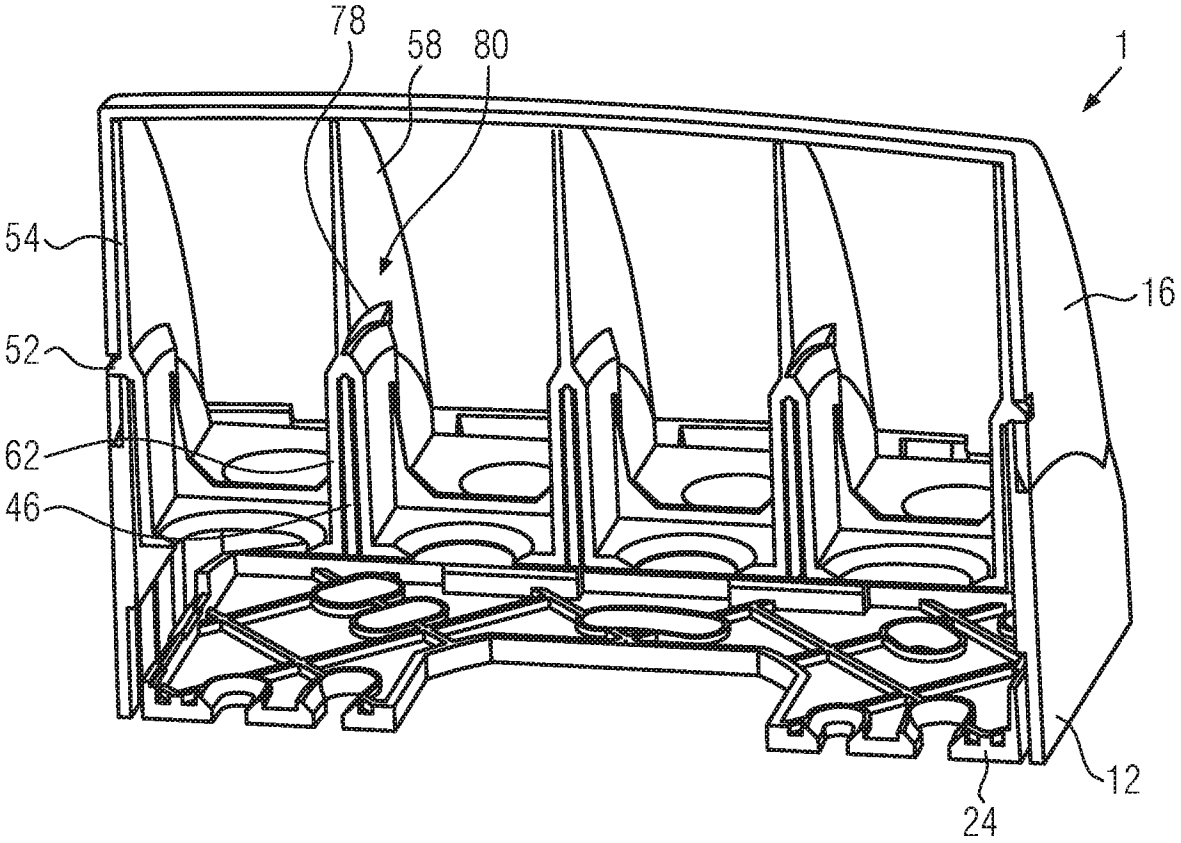
FIG. 6 shows a schematic cu of the corridor indicator lamp according to the invention.

FIG. 6 shows the configuration of FIG. 5 in the assembled state.

It can be seen that the mounting frame 24 is contained within the base assembly 12 and is invisible from the outside. The cover 16 and the extension unit 54 may be positively locked to each other by the latching elements 76. The separation walls 46 are received in the pockets 64 and the extension walls 58 continue the separation walls 46.

A further modification of the corridor indicator lamp 1 may include at least one predetermined breaking line 78 for at least one of the extension walls 58. The predetermined breaking line 78 constitutes a defined area of material weakness, where the extension wall 58 may be broken off. The predetermined breaking line 78 may be located at a base of an extension wall 58 to allow a complete removal of the respective extension wall 58. However, it is also possible that a plurality of predetermined breaking lines 78 is provided, to allow the breaking off of the extension wall 58 at different heights.

The predetermined breaking line 78 extends preferably across the whole width of the connection between the extension wall 58 and the holding structure 60.

As the width of the extension walls 58 may be larger laterally than the width of the holding structure 60, the predetermined breaking line 78 may cover only a central part of the extension wall 58. The areas of the cutout 72 are not connected to the holding structure 60.

Figure 7:
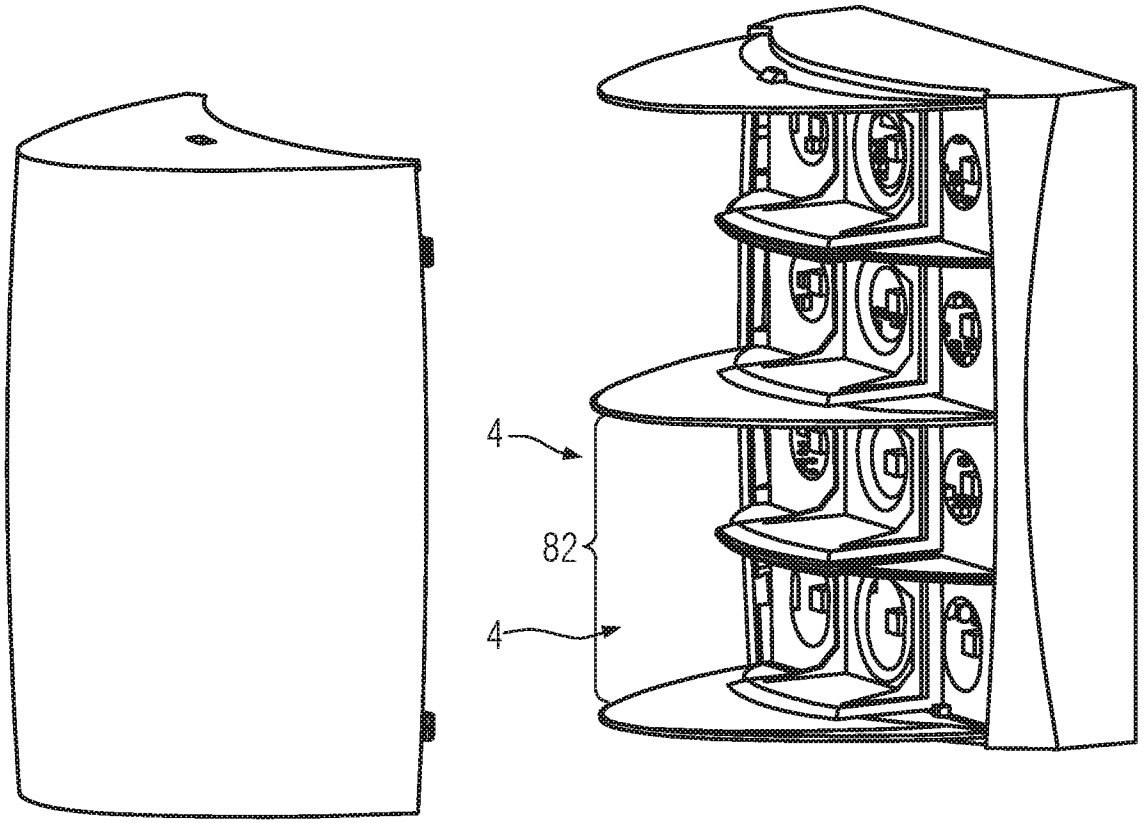
FIG. 7 shows a schematic exploded view of the corridor indicator lamp according to the invention in another configuration.
Figure 8:
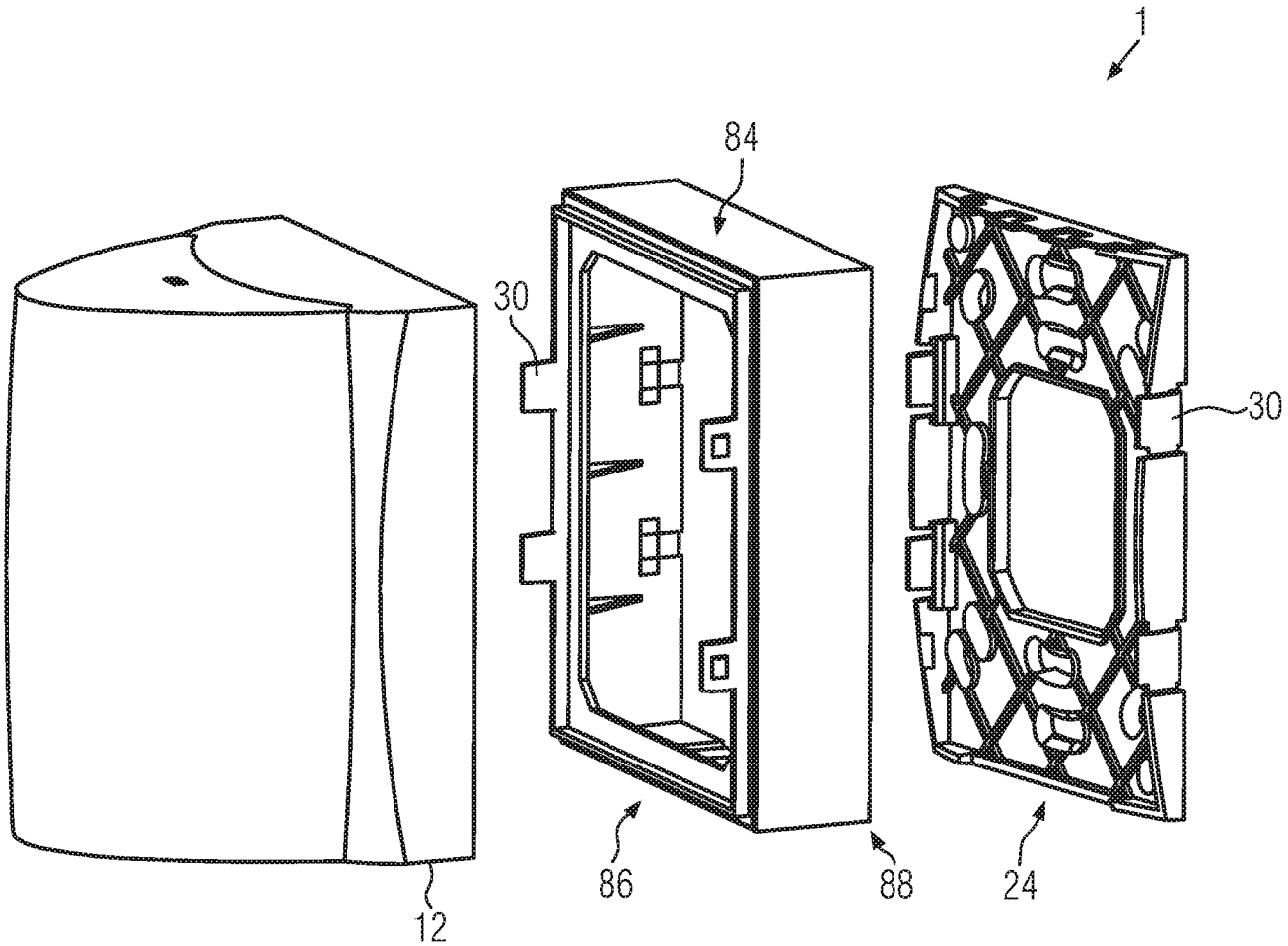
FIG. 8 shows a schematic exploded view of the corridor indicator lamp according to the invention in another configuration.

As is shown in FIG. 7, two or more compartments 4 may be combined to form a compartment 82 by breaking the extension wall 58 off at least partly, preferably at a predetermined breaking line 78.

At some locations, the increased height 22 of the configuration of the corridor indicator lamp 1 shown in FIGS. 2, 5, and 6 may not be sufficient. For this case, an elevation socket 84 may be provided. The elevation socket 84 may be adapted to be attached to the back of the base assembly 12. In particular, the elevation socket 84 may be provided, at one front side 86, with latching means 30, which are identical to the latching means 30 of the mounting frame 24.

Thus, the elevation socket 84 may be attached to the base assembly 12 in place of the mounting frame 24.

At its backside 88, the elevation socket 84 may provide the same structure as the base assembly 12, so that the mounting frame 24 may be attached to the elevation socket 84 in the same manner as to the base assembly 12 and as was described above.

By interposing the elevation socket 84 between the base assembly 12 and the mounting frame 24, the height 22 of the corridor indicator lamp 1 above the support structure 2 (FIG. 1) may be further increased and gives the opportunity to house a greater length of wiring e.g. in case of an on-wall installation, A combination of the cover 16, the cover 23, the extension unit 54 and the base assembly 12 may be used to obtain a highly configurable corridor indicator lamp 1 as described above.

A list of reference numbers includes: corridor indicator lamp 1, support structure 2, compartment 4, wall 6 between compartments, top 8 of corridor indicator lamp, bottom 10 of corridor indicator lamp, base assembly 12, front side 14 of corridor indicator lamp, at least partly transparent cover 16, marking 18, foil 20, height 22 of corridor indicator lamp, at least partly transparent cover 23 (flatter cover), mounting frame 24, central opening 26 of mounting frame, opening 28 for fixation elements in mounting frame, latching means 30 of mounting frame, frame element 32 of base assembly, electric subassembly 34, ESD protection foil 36, front opening 38 of base assembly, latching element 40 of base assembly, socket 42 for light source, transparent areas 44 in ESD protection foil, LED 45, separation wall 46 of base assembly, free end 48 of separation wall, center line 50, latching member 52 of cover, extension unit 54, extension wall 58, holding structure 60, U-shaped brackets 62, pockets 64 of extension unit, legs 66 of brackets, width 68 of front opening of base assembly, socket openings 70 in holding structure, cutout 72 of extension walls, free end 74 of extension wall, latching elements 76 of extension unit and cover, predetermined breaking line 78, base 80 of extension wall, combined compartment 82, elevation socket 84, front side 86 of elevation socket, and backside 88 of elevation socket.

While this invention has been particularly shown and described with references to preferred embodiments thereof, it will be understood by those skilled in the art that various changes in form and details may be made therein without departing from the scope of the invention encompassed by the appended claims.

What is claimed is:

1. A corridor indicator lamp, comprising:

a base assembly, the base assembly including a plurality of compartments, which are open towards a front side of the corridor indicator lamp, and a plurality of separator walls, at least some of the plurality of compartments being separated from each other by at least some of the plurality of separator walls;

an extension unit, which is configured to be mounted to the base assembly and which has a plurality of extension walls each of which is associated with one of the plurality of separator walls to form a respective plurality of extended separator walls, which, in a position where the extension unit is mounted to the base assembly, extend at least one of the plurality of compartments in a direction pointing away from the base assembly, wherein each of the plurality of extended separator walls comprises a separator wall of the plurality of separator walls and a respective extension wall that is coplanar with the separator wall; and an at least partly transparent cover mounted to the base assembly.

2. The corridor indicator lamp according to claim 1, wherein at least some of the extension walls are provided with at least one predetermined breaking line, wherein the predetermined breaking line constitutes a defined area of material weakness.

3. The corridor indicator lamp according to claim 2, wherein at least one of the plurality of extension walls is provided with a base, the base being situated opposite a free end of the at least one of the plurality of extension walls, and wherein the at least one predetermined breaking line is located at the base.

4. The corridor indicator lamp according to claim 1, wherein the extension unit comprises at least one pocket, which is configured to receive at least parts of one of the plurality of separator walls.

5. The corridor indicator lamp according to claim 4, wherein at least one of the plurality of extension walls is aligned with the at least one pocket of a plurality of pockets.

6. The corridor indicator lamp according to claim 4, wherein the at least one pocket covers only part of the associated separator wall.

7. The corridor indicator lamp according to claim 4, wherein the at least one of the plurality of extension walls extends from the at least one pocket of a plurality of pockets.

8. The corridor indicator lamp according to claim 1, wherein at least some of the extension walls are provided with at least one predetermined breaking line, wherein the at least one predetermined breaking line is located between at least one of the plurality of extension walls and an associated pocket.

9. The corridor indicator lamp according to claim 1, wherein at least one of the plurality of extension walls is provided with at least one cutout which is shaped complementary to an associated one of the plurality of separator walls.

10. The corridor indicator lamp according to claim 1, wherein the extension unit is configured to be releasably mounted to the base assembly.

11. The corridor indicator lamp according to claim 1, wherein the at least partly transparent cover has a convexly curved shape corresponding to distal edges of the extension walls, wherein the distal edges of the extension walls contact an interior surface of the cover along an entire width of the distal edges.

12. The corridor indicator lamp according to claim 1, further comprising an elevation socket, the elevation socket configured to be attached to the base assembly opposite the plurality of separator walls.

13. A kit for assembling a corridor indicator lamp, comprising:

a base assembly, the base assembly including a plurality of compartments, which are open towards a front side of the corridor indicator lamp, and a plurality of separator walls, at least some of the plurality of compartments being separated from each other by at least some of the plurality of separator walls;

an extension unit, which is configured to be mounted to the base assembly and which has a plurality of extension walls, which, in a position where the extension unit is mounted to the base assembly, extend at least one of the plurality of compartments in a direction pointing away from the base assembly; and a first cover and a second cover, wherein the first cover or the second cover is at least partly transparent and configured to receive the extension unit, and wherein the first cover protrudes at a greater height from the base assembly than the second cover, the first cover and the second cover being configured to be alternatively mounted to the base assembly.

14. The corridor indicator lamp according to claim 1, wherein the extension walls enlarge at least one of the plurality of compartments of the base assembly in the direction pointing away from the base assembly.

15. The corridor indicator lamp according to claim 1, wherein the extension walls continue the separator walls.

16. The corridor indicator lamp according to claim 1, wherein the location, orientation and alignment of the separator walls correspond to the location, orientation and alignment of the extension walls.

17. The corridor indicator lamp according to claim 1, wherein mounting the extension unit and the cover to the base assembly increases the height of the corridor indicator lamp.

18. The corridor indicator lamp according to claim 13, wherein the extension walls enlarge at least one of the plurality of compartments of the base assembly in the direction pointing away from the base assembly.

19. The corridor indicator lamp according to claim 13, wherein the extension walls continue the separator walls.

20. The corridor indicator lamp according to claim 13, wherein the location, orientation and alignment of the separator walls correspond to the location, orientation and alignment of the extension walls.

* * * * *